United States Patent [19]

Thomas

[11] Patent Number: 4,765,574

[45] Date of Patent: Aug. 23, 1988

[54] MOUNTAIN CLIMBING SAFETY DEVICE

[76] Inventor: Michael D. Thomas, Rt. 6, Box 880, Arab, Ala. 35016

[21] Appl. No.: 118,569

[22] Filed: Nov. 9, 1987

[51] Int. Cl.[4] ..... A47G 29/00

[52] U.S. Cl. ..... 248/1 R

[58] Field of Search ..... 248/1, 317, 200.1, 254.1

[56] References Cited

U.S. PATENT DOCUMENTS

| | | | |
|---|---|---|---|
| 3,880,394 | 4/1975 | Wisecarver | 248/354.1 |
| 4,491,291 | 1/1985 | Ching | 248/1 |
| 4,565,342 | 1/1986 | Grow | 248/1 |
| 4,572,464 | 2/1986 | Phillips | 248/1 |
| 4,575,032 | 3/1986 | Taylor | 248/1 |
| 4,643,377 | 2/1987 | Christianson | 248/1 |
| 4,643,378 | 2/1987 | Guthri et al. | 248/317 X |
| 4,645,149 | 2/1987 | Lowe | 248/1 |
| 4,712,752 | 12/1987 | Brodie | 248/1 |
| 4,715,568 | 12/1987 | Best, Jr. | 248/1 |

*Primary Examiner*—Ramon O. Ramirez
*Attorney, Agent, or Firm*—C. A. Phillips

[57] ABSTRACT

An adjustable device that provides a secure anchor in a crevice or other irregularity. The anchor may be used to assist rock climbers, rescue groups, military personnel, construction workers, etc. The device is comprised of a spring loaded sleeve mounted on a first end of a threaded shaft and limited in its movement on the shaft by a pin and slot arrangement. The sleeve provides a means for adjusting the length of the device. A first locking means releasably secures the sleeve in a retracted position, and a second locking means secures the sleeve at the desired extended position. A lever assembly is provided at the second end of the device in such a manner that a force applied to an attachment point of the assembly will be translated along the longitudinal axis of the device.

9 Claims, 2 Drawing Sheets

MOUNTAIN CLIMBING SAFETY DEVICE

FIELD OF THE INVENTION

This invention relates generally to a device for emplacement in a crevice of a mountain, hill, or the like to serve as an anchor for an individual climbing the mountain, etc. More particularly, this invention relates to such a device which has its length extended responsive to insertion of the device in the crevice.

BACKGROUND OF THE INVENTION

While climbing an obstacle, such as a mountain, rock, etc., the climber generally carries along a plurality of objects which may be placed into an opening, such as a crevice, to provide an anchoring means. These objects are for the purpose of having a rope attached thereto and may be in the form of hooks, wedges, or any of many other irregular shapes.

One type of prior art device used for such a purpose includes a partially threaded shaft having an unthreaded end portion with a pair of spaced gripping members each pivotally mounted on opposite sides thereof. A connecting pull cord is secured between the gripping members. The pivoted gripping members are each spring biased to rotate upwardly away from the unthreaded end of the shaft. An extensible sleeve is secured in threaded relation with the threaded portion of the shaft and is disposed for movement along the threaded portion of the shaft to extend the length of the device. To operate the device, the user apparently roughly estimates the distance between the surfaces of the opening which are to be engaged by the device and adjusts the length of the device accordingly. Adjustment is effected by rotating the sleeve by hand on the threaded shaft. Then, the user must hold each gripping member against the bias of the spring until the device is placed in the crevice, at which time the gripping members pivot slightly to engage the surfaces adjacent the crevice. A rope may be secured to a lanyard which extends downwardly from a pair of ears which extend from the gripping members.

SUMMARY OF THE INVENTION

A mountain climbing device which is placed in a crevice of a mountainside for gripped engagement with surfaces adjacent the crevice. The device includes a body having a threaded shaft extending from one end thereof. An extensible member is mounted on the threaded shaft and is spring biased outwardly to extend the device to varying lengths for engagement in crevices of different widths. The distal end of the extensible member is disposed for engagement with a first surface adjacent the crevice. A pivoted support member disposed for receiving a rope in secured relation thereon is pivotally secured to the other end of the body, and a lever member is pivotally secured to the pivotal support member for engaging a second surface adjacent the crevice. A first locking member locks the extensible member in a retracted position and also releases the extensible member for outward biased movement thereof to engage the first surface on one side of the crevice. A second locking member locks the extensible member in its extended position in engagement with the surface. Both locking members are manipulated by one hand. In response to a downward force being applied to the rope, the support member is rotated downwardly to force the lever member against the second surface adjacent to the crevice to further wedge the device in the crevice and thus enhance the gripping force of the device. The gripping force of the device increases as the downward force on the support member is increased.

DESCRIPTION OF THE PREFERRED EMBODIMENT

Figure 1:
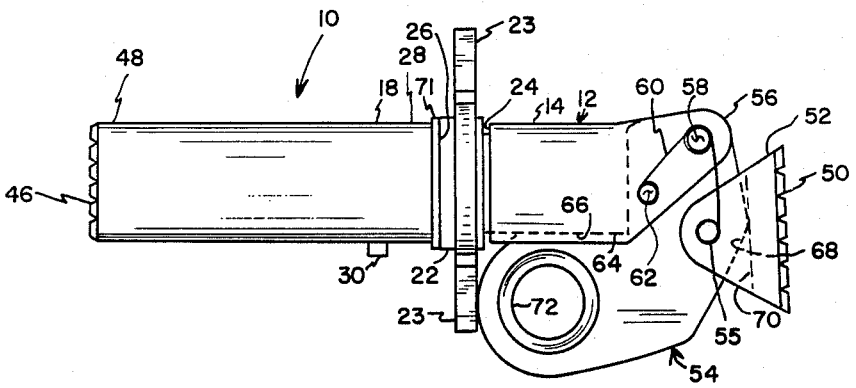
FIG. 1 is an elevational view of the device of the present invention including an extensible sleeve shown in a retracted position.
Figure 2:
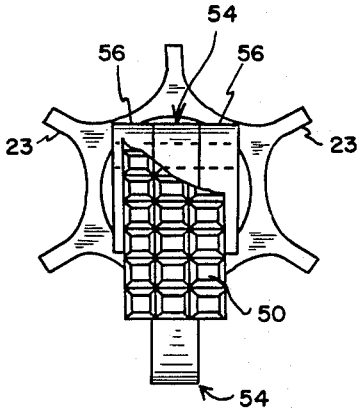
FIG. 2 is an end elevational view of the device of FIG. 1.
Figure 4:
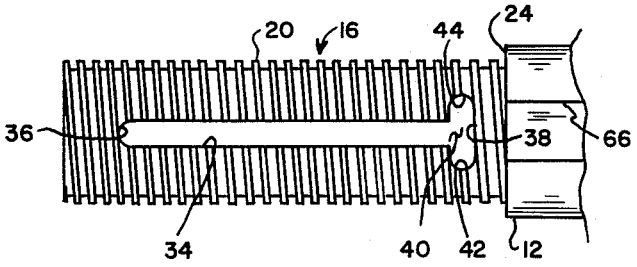
FIG. 4 is a bottom elevational view taken along line 4—4 of FIG. 3.
Figure 3:
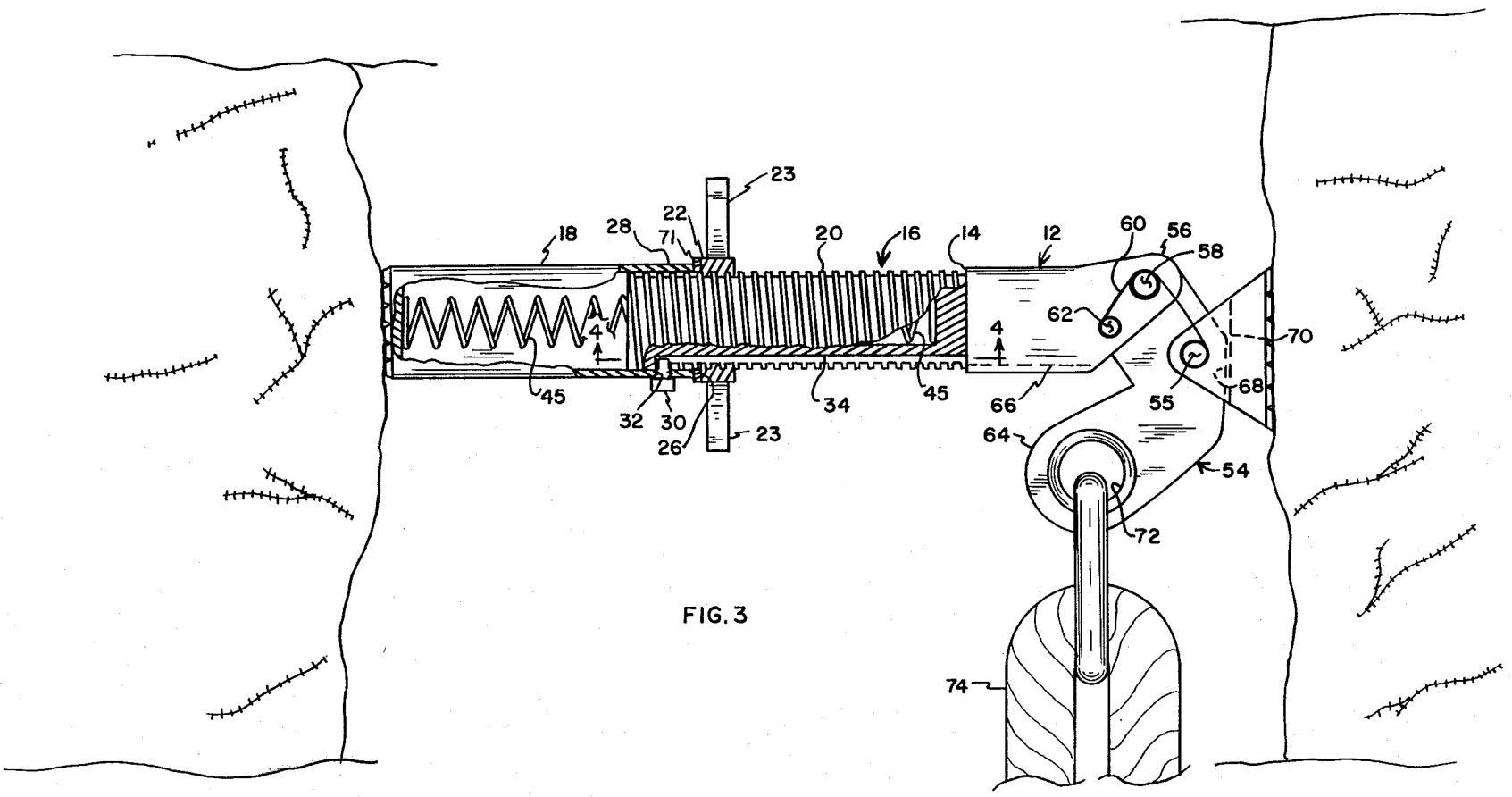
FIG. 3 is an elevational view, partially in section, of the device of FIG. 1 with the extensible sleeve in an extended position and with a stop member in abutting relation with the sleeve to secure the sleeve in an extended position.

As seen in FIGS. 1 and 3, a device 10 for assisting an individual in climbing mountains, hills, etc., includes a body 12 having an end 14 provided with an elongated extending portion 16 having a sleeve 18 slidably mounted thereon. Elongated portion 16 is provided with threads 20 (FIGS. 3 and 4) to receive a nut 22 thereon in threaded relation. The nut includes radially extending arms 23. The nut is mounted intermediate a shoulder 24 of body 12 and a shoulder 26 disposed adjacent an end 28 of sleeve 18. To retain the sleeve on the elongated portion 16, a pin 30 (FIG. 3) is threaded in an opening 32 disposed in sleeve 18 adjacent end 28 thereof. The pin extends into a longitudinal slot 34 (FIGS. 3 and 4) in portion 16. The slot includes stops 36 and 38 at opposite ends thereof to limit the travel of the sleeve along portion 16. Stop 38 (FIG. 4) includes a groove 40 extending normally across slot 34 to form a pair of recesses 42 and 44 to receive locking pin 30 therein to retain the sleeve in a retracted position. A spring 45 is mounted in sleeve 18 and in threaded portion 16 to bias the sleeve to an extended position as shown in FIG. 3.

To provide a means for gripping engagement of the device with surfaces of the mountain, sleeve 18 includes a roughened or uneven surface 46 (FIG. 1) at the end 48 thereof. A second gripping surface is provided by an uneven surface 50 on a member 52 which is pivotally secured to a support member 54 by a pin 55. Support member 54 is pivotally secured to an end 56 of body 12 by a pin 58. A spring 60 is secured to a pin 62 on body 12 and to pin 55 on member 54. Spring 60 biases member 54 upwardly for mating engagement of a surface 64 thereof with a mating surface 66 on body 12. Members 52 and 54 are provided with surfaces 70 and 68, respectively, which are disposed for mating relation during operation of the device. A resilient member, such as a belville washer 71, is positioned on threaded portion 16 between nut 22 and shoulder 26 of sleeve 18. The device may be made of a lightweight material, such as aluminum, so as to minimize the load carried by the mountain climber.

In operation, the user places the device in a crack or opening in the surface of the object, such as a mountain, to be climbed. The device is then in its retracted position as shown in FIG. 1. The operator then rotates sleeve 18, by one hand if necessary, to move pin 30 out of either of recesses 42 or 44 and into slot 34 for movement therealong. The sleeve is rapidly propelled along portion 16 by the bias of spring 45 to a position where it is engaged with a bearing surface along the crack or opening in the rock. Surface 50 of member 52 is disposed for engagement with a second spaced surface of the opening to wedge the device therein. The operator then rotates the nut 22 along threaded portion 16 by rotating the radially extending arms 23 of the nut. The nut is moved along portion 16 until it engages and compresses washer 71 against end 26 of sleeve 18. Nut 22 retains the sleeve in its extended position and in engagement with the surface adjacent the opening in the mountain. Washer 71 is resilient and compensates for minor changes in the surfaces of the rocks (which may be caused by ablation and the like) by expanding from its compressed state to apply a steady axial force against end 26 of sleeve 18 to maintain end 46 of the sleeve snugly against the surface of the rock. A rope 74 is attached through an opening 72 in member 54 by the user. The rope is attached to the anchor device and to the individual.

It should be apparent that the applicant has provided a device for use by climbers which is light in weight and which is easily handled by one hand during emplacement in a crevice, thus permitting the individual to use the other hand to hold on to another surface of the rock. Additionally, it should be readily apparent that if a force should be applied to the device by pulling downwardly on the rope, this downward force would be translated substantially along the longitudinal axis of the device, thus causing member 52 to wedge against the surface adjacent the opening in the mountain. The mechanical advantage gained by the leverage action of member 52 increases the gripping force of the device.

What is claimed is:

1. A device for emplacement in a gap of an obstacle to be climbed to provide a secure anchor therein, said device comprising:

a body having first and second ends, an elongated threaded portion extending from said first end, and gripping means secured to said second end;

an extensible member carried by said elongated portion in biased relation therewith for movement therealong;

first locking means for releasably securing said extensible member to said elongated portion for retention of said extensible member in a first retracted position and for release of said extensible member for movement thereof to a second extended position for engagement with a first surface adjacent said gap;

biasing means for biasing said extensible member to said extended position responsive to release thereof by said first locking means;

second locking means for releasably retaining said extensible member in said extended position; and said gripping means pivotally secured to said second end of said body for engagement with a second surface adjacent said gap, said gripping means disposed for rotational movement responsive to a downward force acting thereof, whereby said rotational movement causes said device to be further wedged in said gap, thus enhancing the anchoring effect of said device in said gap.

2. A device as in claim 1 wherein said extensible member is a spring biased sleeve carried by said elongated member.

3. A device as in claim 2 wherein said sleeve is slidably mounted on said elongated member and is provided with a pin extending therefrom, and said first locking means includes a slot extending substantially along the length of said elongated member and having an offset portion at one end thereof, said pin disposed in said slot for movement therealong and for insertion into said offset portion of said slot for retention of said sleeve in said retracted position.

4. A device as in claim 3 wherein said elongated member is externally threaded along the length thereof, and said second locking means includes a nut disposed in threaded engagement with said elongated member for movement therealong, said nut being disposed for retention of said sleeve in said extended position.

5. A device as in claim 4 wherein said gripping means includes a first support member pivotally mounted to said second end of said body in biased relation therewith and a lever member pivotally mounted to said support member.

6. A device as in claim 5 including a spring secured to said second end of said body and to said support member for the biased relation.

7. A device as in claim 6 wherein said support member includes an opening to receive a rope therein.

8. A device as in claim 7 including a resilient member disposed between said sleeve and said nut for application of an axial force therebetween.

9. A device as in claim 8 wherein said resilient member is a belville washer.

* * * * *